United States Patent [19]

Held et al.

[11] Patent Number: 4,799,427

[45] Date of Patent: Jan. 24, 1989

[54] PROJECTILE IGNITION DEVICE

[75] Inventors: Manfred Held, Aresing; Horst Kirsche, Munich, both of Fed. Rep. of Germany

[73] Assignee: Messerschmitt-Bölkow-Blohm GmbH, Munich, Fed. Rep. of Germany

[21] Appl. No.: 152,079

[22] Filed: Feb. 4, 1988

[30] Foreign Application Priority Data

Apr. 7, 1987 [DE] Fed. Rep. of Germany ..... 3711698

[51] Int. Cl.[4] ..... F42C 11/06

[52] U.S. Cl. ..... 102/215; 102/206; 102/266

[58] Field of Search ..... 102/206, 215, 216, 262, 102/265, 266

[56] References Cited

U.S. PATENT DOCUMENTS

| | | | |
|---|---|---|---|
| 4,019,440 | 4/1977 | Strike | 102/215 |
| 4,063,513 | 12/1977 | Kadish et al. | 102/206 |
| 4,375,192 | 3/1983 | Yates et al. | 102/215 |
| 4,455,939 | 6/1984 | Munzel | 102/215 |
| 4,480,550 | 11/1984 | Abt | 102/215 |
| 4,580,498 | 4/1986 | Abt et al. | 102/215 |
| 4,667,598 | 5/1987 | Grobler et al. | 102/215 |

FOREIGN PATENT DOCUMENTS

| | | | |
|---|---|---|---|
| 3141333 | 5/1983 | Fed. Rep. of Germany | 102/215 |
| 3436397 | 5/1985 | Fed. Rep. of Germany | 102/216 |

*Primary Examiner*—Charles T. Jordan

*Attorney, Agent, or Firm*—Kenyon & Kenyon

[57] ABSTRACT

An ignition device for a projectile, in particular a guided missile, where the ignition moment is controllable as a function of the impingement delay and of the flight time of the projectile. This allows compensation for the type of material comprising the taget, e.g., hard or soft, and for the amount of time the projectile has been airborne, thus compensating for reduced projectile velocity at the time of striking the target.

8 Claims, 1 Drawing Sheet

PROJECTILE IGNITION DEVICE

BACKGROUND OF THE INVENTION

The present invention relates to an ignition device for a projectile penetrating into a target having an electronic ignition delay device adjustable in accordance with sensor signals.

Such a projectile may be designed as a guided missile, in the tip of which a control (steering) device, for example, control nozzles fed by a gas generator, is arranged. The active part of the projectile may be a hollow charge or also a flat- or projectile-forming charge or a blast charge. Due to the control (steering), guided missile has a high hit probability even at very great distances. However, despite an initial velocity of about 1000 m/s, the missile has a striking velocity in the range of only 300 to 500 m/s. These are speeds at which the projectile is no longer able to penetrate into certain armor platings. It is desirable, however, that the projectile should cause the greatest possible damage in any case.

From DE-PS No. 31 41 333 a percussion fuse for a projectile penetrating through the outer walls of target objects has become known in which a variable ignition delay dependent on the impingement angle is provided, which delay is caused by purely electronic means in accordance with sensors. Such an ignition delay circuit, however, is unable to bring about ignition at the optimum moment after any designed flight times of the projectile.

SUMMARY OF THE INVENTION

It is, therefore, an object of the present invention to provide an ignition device for projectiles such that the delay of the ignition moment of the active charge of the projectile is determinable on the basis of the intensity of the impingement delay, taking into consideration the dependence of the ignition moment on the flight time of the projectile.

The above and other objects of the invention are achieved by an ignition device for a projectile penetrating into a target having electronic ignition delay means adjustable in accordance with sensor signals, comprising threshold circuit means having an input coupled to receive an output signal of an acceleration sensor, the threshold circuit means having output signals which occur, depending on the amplitude of the output signal of the acceleration sensor, when a signal threshold is fallen short of or exceeded, and which activate a time delay circuit having at least two delay ranges, said time delay circuit having an output signal which triggers the ignition of an active charge in the projectile, the mean duration of the delay time being short for high output signals of the acceleration sensor and longer for low output signals of the acceleration sensor.

Preferably, a measuring circuit determining the flight time of the projectile is connected to the time delay circuit for the purpose of lengthening the delay time within the delay time range as a function of the flight time.

A special advantage of the ignition device according to the invention resides both in that due to the intensity of the impingement delay observable upon impingement, which of course is proportional to the hardness of the target the delay of the ignition moment is adjustable longer or shorter, as well as that the longer or shorter time delay itself is extendible according to the flight duration within a certain range. Thereby the ignition is triggered at the optimum moment in any case.

An embodiment of the invention is illustrated in the drawings and will be explained in greater detail in the following description.

DETAILED DESCRIPTION

Figure 1:
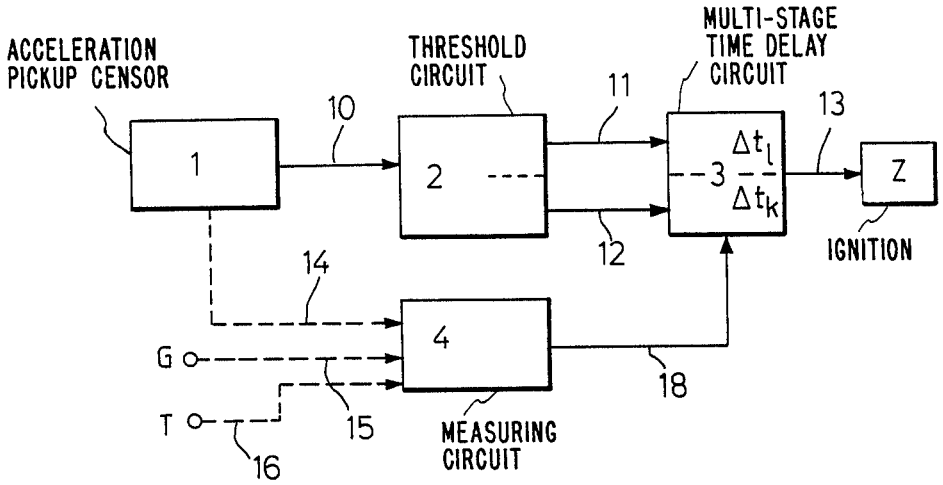
FIG. 1 shows a block diagram of an ignition device for projectiles.

In FIG. 1 is shown a schematically simplified block diagram of an ignition device for a projectile, in particular a guided missile.

The output signal 10 of an acceleration pickup sensor 1 disposed in the projectile, which pickup measures the acceleration at target impingement and thus permits distinguishing between soft and hard targets, activates the input of a threshold circuit 2. This threshold circuit 2 may be designed as a simple threshold switch of known design. Here all output signals 10 of the acceleration pickup 1 which are below a certain adjustable threshold value generate an output signal 11. All output signals 10 of the acceleration pickup 1 which exceed the threshold value cause a different output signal 12. According to one design of the threshold circuit, the latter may also have several threshold values. In that case, for example, a base threshold, whose level is adjusted relatively low, serves to blank out interference signals. The thresholds adjusted higher are then used to determine certain amplitude ranges of the output signal 10 of the acceleration pickup.

The output signals 11, 12 of the threshold circuit 2 assigned to various signal thresholds now activate a multistage time delay circuit 3. In the embodiment, the following values were chosen for this circuit: The short delay time $\Delta t_k$, which becomes active at high signal amplitudes, is for instance 50 microsec and the longer delay time $\Delta t_l$ for instance 500 microsec. These delay times come about as follows: The requirement regarding the delay times for the ignition of the active charge of a guided missile is such that the active charge is to respond after a relatively short time upon impingement on a hard target into which the projectile cannot penetrate. The relatively short time is needed to enable the projectile to snap off or break off and move away the projectile tip containing the control (steering) device. Assuming a projectile speed of about 1000 m/s, there is needed for the shearing off of the projectile tip a path of about 50 mm, whence results the delay time of 50 microsec.

If, however, the projectile hits a soft target, the detonation is to occur say 500 mm inside the target. From this results the longer delay time of say 500 microsec.

However, since at the maximum target distance the projectile has only a velocity of say 300 m/s, it is necessary to lengthen the delay times according to the reduced speed in order to achieve the same penetration before detonation. For this reason, there is provided in the ignition device a measuring circuit 4 for measuring the flight time t of the projectile. The time measurement of the measuring circuit can be started by various events. For example, the firing acceleration can be determined by the acceleration pickup 1 and used as start signal 14. Alternatively, the ignition signal 15 for the gas generator G of the control device of the guided missile or the ignition signal 16 for a thermal battery T may be used for this purpose as well.

In any case, the measuring circuit 4 activates the time delay circuit 3 via line 18. Thereby the short delay time $\Delta t_k$ is adjusted in the range of 50 to 150 microsec and the long delay time in the range of 500 to 1500 microsec, depending on the flight duration.

The ignition Z then occurs upon impingement on the target in accordance with the amplitude of the acceleration signal 10 either after the long or after the short delay time.

Figure 2:
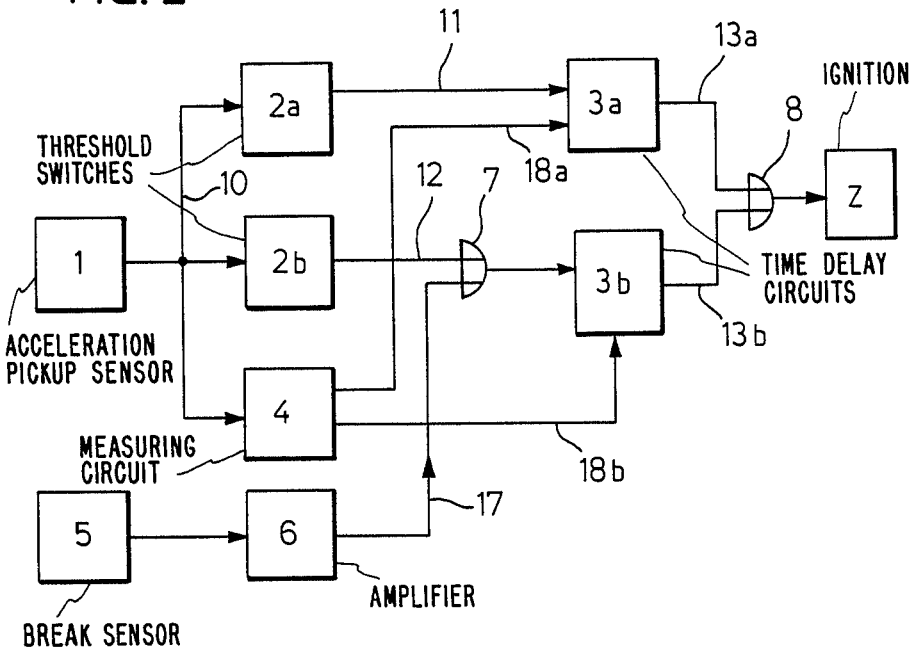
FIG. 2 shows a variant of the block diagram of FIG. 1.

FIG. 2 shows another embodiment of the circuit according to FIG. 1. For one thing, here the threshold circuit 2 has been realized as two separate threshold switches 2*a* and 2*b*, to which are then connected the time delay circuits 3*a* and 3*b*, which are influenced via the measuring circuit 4 by means of the lines 18*a* and 18*b*. The output signals 13*a*, 13*b* of the time delay circuits 3*a*, 3*b* are combined via a logic gate 8, which in turn activates the ignition Z directly. Secondly, the circuit according to FIG. 2 contains a break sensor 5 which, for example, through an amplifier 6, activates a logic gate 7 inserted in the output line 12 which relays the short delay time $\Delta t_k$, thus superimposing the output signal 12. The break sensor 5 is, for example, a wire inserted at the point of inflection between the control unit and the active part of the projectile. If the wire breaks off during oblique impingement, the ignition is triggered after the short delay time $\Delta t_k$.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. An ignition device for a projectile penetrating into a target having electronic ignition delay means adjustable in accordance with sensor signals comprising:

threshold circuit means having an input coupled to receive an output signal from an acceleration sensor;

said threshold circuit means generating output signals which occur, depending on the amplitude of the output signal from the acceleration sensor, when a signal threshold is fallen short of or exceeded, and which activate a time delay circuit means generating a time delay having at least two delay ranges;

said time delay circuit means having an output signal which triggers the ignition of an active charge in the projectile, the mean duration of the delay time being short for high output signals from the acceleration sensor and longer for low output signals from the acceleration sensor.

2. The ignition device recited in claim 1, further comprising a measuring circuit for determining the flight time of the projectile coupled to the time delay circuit for lengthening the delay time within the delay time range as a function of the flight time of the projectile.

3. The ignition device recited in claim 2, wherein the measuring circuit is responsive to an output signal of the acceleration sensor.

4. The ignition circuit recited in claim 2, wherein the measuring circuit is responsive to an ignition signal from a gas generator of a control device of the projectile.

5. The ignition circuit recited in claim 2, wherein the measuring circuit is responsive to an ignition signal for a thermal battery of the projectile.

6. The ignition device recited in claim 1, wherein the threshold circuit means has a plurality of signal thresholds for distinguishing the signals provided by the acceleration sensor.

7. The ignition device recited in claim 1 wherein an output signal of a break sensor is imposed on the output signal of the threshold circuit means which brings about the activation of the short delay time of the time delay circuit means.

8. The ignition device recited in claim 7 wherein the output signal of the break sensor is imposed on the output signal of the threshold circuit means by logic means.

* * * * *